US007557519B2

(12) United States Patent
Kranz

(10) Patent No.: US 7,557,519 B2
(45) Date of Patent: Jul. 7, 2009

(54) CONTROLLING POWER TO LIGHT-EMITTING DEVICE

(75) Inventor: Christian Kranz, Ratingen Lintorf (DE)

(73) Assignee: Infineon Technologies AG, Neubiberg (DE)

( * ) Notice: Subject to any disclaimer, the term of this patent is extended or adjusted under 35 U.S.C. 154(b) by 341 days.

(21) Appl. No.: 11/532,011

(22) Filed: Sep. 14, 2006

(65) Prior Publication Data

US 2008/0067953 A1 Mar. 20, 2008

(51) Int. Cl.
*G05F 1/00* (2006.01)

(52) U.S. Cl. ..... 315/291; 315/307; 315/224; 345/82

(58) Field of Classification Search ..... 315/291, 315/308, 224, 302, 209 R, 307; 345/82, 345/84, 83, 170; 362/800, 157
See application file for complete search history.

(56) References Cited

U.S. PATENT DOCUMENTS 6,320,330 B1 * 11/2001 Haavisto et al. ..... 315/291
6,329,760 B1 * 12/2001 Bebenroth ..... 362/800
6,734,639 B2 * 5/2004 Chang et al. ..... 315/291
7,259,525 B2 * 8/2007 Yang ..... 345/82
7,295,176 B2 * 11/2007 Yang ..... 345/82
2006/0164826 A1 * 7/2006 Ackermann et al. ..... 362/157

* cited by examiner

*Primary Examiner*—Douglas W Owens
*Assistant Examiner*—Ephrem Alemu
(74) *Attorney, Agent, or Firm*—Schwegman, Lundberg & Woessner, P.A.

(57) ABSTRACT

A circuit to control power to a light-emitting device connected in parallel to an inductive device switching current to the parallel combination repeatedly between a charge state during which said inductive element is charged and a discharge state during which said inductive element is discharged through said light-emitting device. A method to control power to a light-emitting device to switch current to a parallel connection of an inductance device and a light-emitting device repeatedly between a charge state during which said inductive element is charged and a discharge state during which said inductive element is discharged through said light-emitting device.

20 Claims, 11 Drawing Sheets

CONTROLLING POWER TO LIGHT-EMITTING DEVICE

TECHNICAL FIELD

Embodiments of the invention described herein relate generally to light-emitting devices, and more particularly to controlling power to light-emitting devices.

BACKGROUND

Computer systems and other electronic systems provide for a large number of stationary, mobile, portable and hand-held devices. These systems generally comprise a user interface with a display and keys. The display may comprise light-emitting elements, such as light-emitting diodes, for displaying information or for illuminating the display. Furthermore, the keys, that may be arranged in a key pad, may comprise light-emitting elements, such as light-emitting diodes, for illuminating the keys or providing information to the user on the keys. As physical dimensions of these devices grow smaller and demands on the displays and keys grow larger, power consumption of these systems in general and the light-emitting devices in particular plays an important role.

BRIEF DESCRIPTION OF THE DRAWINGS

While the specification concludes with claims particularly pointing out and distinctly claiming that which is regarded as the invention, a more particular description of the invention will be rendered by reference to specific embodiments thereof, which are depicted in the appended drawings, in order to illustrate the manner in which embodiments of the invention are obtained. Understanding that these drawings depict only typical embodiments of the invention, that are not necessarily drawn to scale, and, therefore, are not to be considered limiting of its scope, embodiments will be described and explained with additional specificity and detail through use of the accompanying drawings in which:

DETAILED DESCRIPTION

Figure 1:
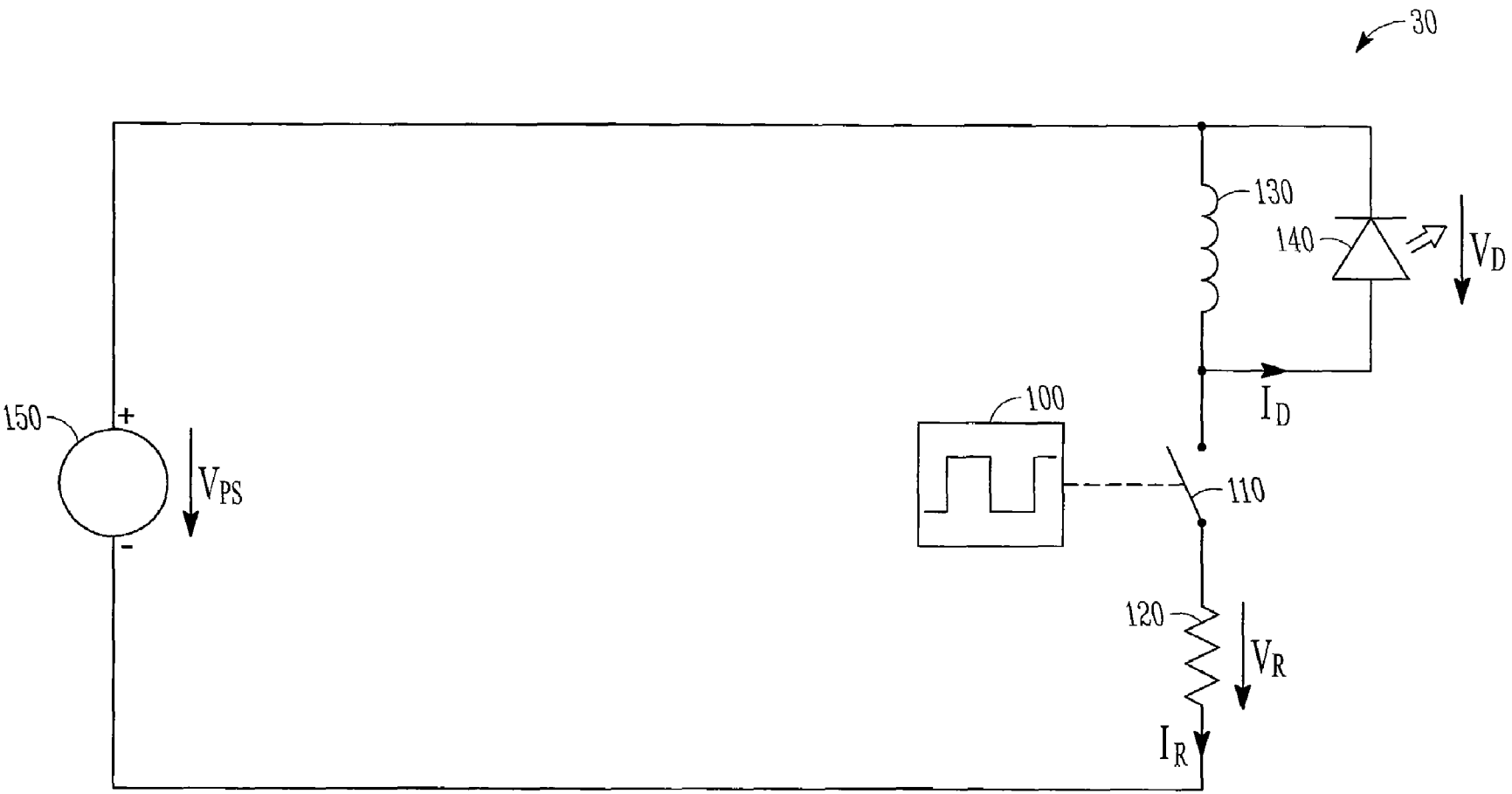
FIG. 1 shows a schematic diagram of an embodiment of the invention.

In the following detailed description of the embodiments, reference is made to the accompanying drawings which form a part hereof and show, by way of illustration, specific embodiments in which the invention may be practiced. In the drawings, like numerals describe substantially similar components throughout the several views. The embodiments are intended to describe aspects of the invention in sufficient detail to enable those of skill in the art to practice the invention. Other embodiments may be utilized and structural, logical or electrical changes or combinations thereof may be made without departing from the scope of the invention. Moreover, it is to be understood, that the various embodiments of the invention, although different, are not necessarily mutually exclusive. For example, a particular feature, structure or characteristic described in one embodiment may be included within other embodiments. Furthermore, it is to be understood, that embodiments of the invention may be implemented in discrete circuits, partially integrated circuits or fully integrated circuits or programming means. Also, the term "exemplary" is merely meant as an example, rather than the best or optimal. The following detailed description is, therefore, not to be taken in a limiting sense, and the scope of the invention is defined only by the appended claims, along with the full scope of equivalents to which such claims are entitled.

Reference will be made to the drawings. In order to show the structures of the embodiments most clearly, the drawings included herein are diagrammatic representations of inventive articles. Thus, actual appearance of the fabricated structures may appear different while still incorporating essential structures of embodiments. Moreover, the drawings show only the structures necessary to understand the embodiments. Additional structures known in the art have not been included to maintain clarity of the drawings. It is also to be understood, that features and/or elements depicted herein are illustrated with particular dimensions relative to one another for purposes of simplicity and ease of understanding, and that actual dimensions may differ substantially from that illustrated herein.

In the following description and claims, the terms "include", "have", "with" or other variants thereof may be used. It is to be understood, that such terms are intended to be inclusive in a manner similar to the term "comprise".

In the following description and claims, the terms "coupled" and "connected", along with derivatives such as "communicatively coupled" may be used. It is to be understood, that these terms are not intended as synonyms for each other. Rather, in particular embodiments, "connected" may be used to indicate, that two or more elements are in direct physical or electrical contact with each other. However, "coupled" may mean that two or more elements are in direct contact with each other but may also mean that two or more elements are not in direct contact with each other, but yet still co-operate or interact with each other.

In the following description and claims, terms, such as "upper", "lower", "first", "second", etc., may be only used for descriptive purposes and are not to be construed as limiting. The embodiments of a device or article described herein can be manufactured, used, or shipped in a number of positions and orientations.

FIG. 1 shows apparatus 10 in accordance with an embodiment of the invention, that is a computer system or other electronic system. In some embodiments, apparatus 10 forms part of a stationary, mobile, portable or hand-held device, such as a mobile telephone, such as a Global System for Mobile Communications (GSM) or Universal Mobile Telecommunications System (UMTS) telephone, or a cordless telephone. In some embodiments it may be a Digital Enhanced Cordless Telecommunications (DECT) telephone. In some embodiments, the apparatus 10 provides illumination for the computer system or the electronic system, for example for a display, backlit display, key or keys of a key pad.

In FIG. 1, apparatus 10 comprises a generator (SG) 100, a switching element (S) 110, an inductive element (L) 130 and a unidirectionally conductive light-emitting device (D) 140, which in some embodiments is a light emitting diode. Light emitting device 140 emits light when current is passed through it in its conductive direction and is non-conducting and non light-emitting when the voltage across it back biases its diode junction. In various embodiments, light can be produced by a light emitting diode or, in some embodiments, by a light source which has unidirectional current conducting capability. In some embodiments, the unidirectional conductive light emitting device is a light source with bi-directional current conducting capability coupled in series with an element which has a unidirectional current conducting capability. In this document, light emitting device 140 shall be considered to be unidirectionally conductive unless otherwise specified.

The apparatus 10 may further comprise a resistive element (R) 120. Apparatus 10 is coupled to a power supply (PS) 150. In some embodiments, power supply 150 may be a mains adapter, a battery or a rechargeable battery. Power supply 150 provides a supply voltage, $V_{PS}$, between a positive terminal (+) and negative terminal (−). Thus, the power supply 150 provides a direct current (DC). The inductive element 130 is coupled in parallel to the light-emitting device 140. The inductive element 130 and the light-emitting device 140 are coupled to the power supply 150, for example to the positive terminal, and to the switching element 110. In some embodiments, the switching element S 110 is coupled to the power supply 150, for example to the negative terminal. In other embodiments it is coupled to the power supply PS 150 via the resistive element 120, for example a resistor or a shunt.

In some embodiments, a generator 100 is coupled to the switching element 110 to switch it repeatedly between a charged state during which the inductive element 130 is charged by coupling it to receive current from the power supply, while the light-emitting device is back-biased and non-conducting, and a discharged state during which the inductive element 130 is discharged through the light-emitting device 140. In some embodiments, the generator 100 is a signal generator, for example a square-wave signal generator, generating a signal having an on-time of duration $T_1$ and an off-time of duration $T_2$. In some embodiments, the generator SG 100 may have an input, for example a control input for controlling duration of the on-time interval while the switch is conductive and/or duration of an off-time interval when the switch is non-conductive, based on a feedback signal, that may originate, in some embodiments, from a comparing element, or in some embodiments from a timing signal.

In some embodiments, switching element 110 may be a switch or transistor, such as a bipolar transistor or field-effect transistor (FET), such as an n-channel FET. The light-emitting device D 140 may comprise a light-emitting diode (LED), such as an organic LED (OLED) or polymer LED (PLED). The light-emitting device may emit red, green, yellow or blue color, or a combination thereof, for example white color. A light-emitting diode emitting white color usually has a high on voltage. In some embodiments, the light-emitting device D 140 may comprise a plurality of light-emitting elements, that may be coupled in series, in parallel or mixed as discussed with reference to FIG. 2.

In some embodiments, the light-emitting device 140 provides illumination for a backlit display, key or keys, or a display such as a dot-matrix or segment, for example 7-segment, display. In some embodiments, for touch-sensing applications, light-emitting device 140 comprises bi-directional LEDs. While, in some embodiments, the light-emitting device 140 comprises at least one light-emitting diode, in some other embodiments, the light-emitting device 140 comprises a valve element, such as a diode, coupled in series to a non-directional light-emitting element, such as a bulb. In some embodiments, the light-emitting device 140 may further comprise a resistive element (not shown) coupled in series in order to limit current the forward current, $I_D$, passing through the light-emitting device 140.

The light-emitting device 140 comprises a p-side terminal, that is an anode, and an n-side terminal, that is a cathode. The p-side terminal of the light-emitting device 140 is coupled to the negative terminal of the power supply 150, and the n-side of the light-emitting device 140 is coupled to the positive terminal of the power supply 150 such that the supply voltage $V_{PS}$ does not drive supply current $I_R$ through the light-emitting device.

During on-time of duration $T_1$ of the generator 100, switching element 110 is closed, and the inductive element 130 receives current so that it is "charged". During off-time of duration $T_2$ of generator 100, the switching element 110 is opened and a light-emitting device drive current $I_D$ flows through the light-emitting device 140, and the inductive element 140 is discharged as its magnetic field collapses, driving an inductive discharge current through light-emitting device 140. In some embodiments, duration of the charge state may be variable, that is duration of the charge state may be prescribed or controlled in relation to a peak current $I_{R_peak}$, that may be detected by a comparing element, such as a comparator (not shown). In some embodiments, duration of the discharge state may be fixed, prescribed in relation to supply voltage $V_{PS}$ and on-voltage of the light-emitting device 140 or may be determined by a calculation such as discussed with reference to FIG. 5, for example.

A feature of some embodiments of the apparatus 10 includes a reduced number of discrete and external components thereby reducing overall cost compared to techniques that employ Schottky diodes and block capacitors. In some embodiments, a feature of the apparatus 10 is reduced power consumption. Reduced power consumption may result in increased efficiency and reduced costs in terms of a cheaper stationary, mobile, portable or hand-held device, reduced costs of operation or both.

Some conventional systems utilize DC/DC boost converters. However, implementation of such DC/DC boost converters requires a number of discrete, that is chip-external components. Furthermore, flexibility of DC/DC boost converters is limited. If a higher voltage is employed, implementation of the DC/DC boost converter requires a discrete switching transistor. However, owing to utilization of the discrete switching transistor the light-emitting device may not be fully separated from the supply voltage. As a consequence, a leakage current may flow through the light-emitting device. As a consequence power may be consumed without any desirable effect such as light generation.

Alternatively, other conventional systems may utilize charge pumps. However, utilization of charge pumps may not be cost-efficient if a plurality of light-emitting devices are coupled in series.

In some embodiments of the invention, apparatus 10 provides for higher flexibility in terms of configuration of the light-emitting device 140, such as serial, parallel or mixed coupling of light-emitting elements. The light-emitting device 140 may also be fully disconnected from the power supply 150, thus, avoiding leakage current through light-emitting device 140.

In some embodiments, as light emission of the light-emitting device 140 is controlled by duration $T_1$ of the charge state, that is on-time, and duration $T_2$ of the discharge state, that is off-time, variations of device characteristics in the inductive element 130, light-emitting device 140, and power supply 150, that are time-dependent, is compensated by calibrating apparatus 10.

FIG. 2 shows several embodiments of connection configurations of the light-emitting device.

Figure 2A:
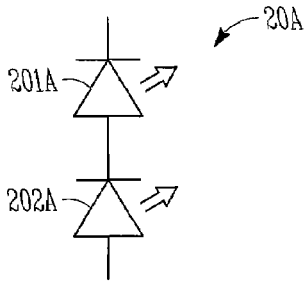
FIGS. 2*a* to 2*d* show schematic diagrams of configurations of the light-emitting device.

FIG. 2*a* shows an embodiment of light-emitting device 20*a* comprising two light-emitting elements 201*a* and 202*a*, such as light-emitting diodes. Light-emitting elements 201*a* and 202*a* are coupled in series. If the light-emitting elements 201*a* and 202*a* are light-emitting diodes, a p-side terminal of a first light-emitting diode 201*a* is coupled to an n-side terminal of a second light-emitting diode 202*b*.

The light-emitting elements 201*a* and 202*a* may be of a same type or different types. The light-emitting device 20*a* may further comprise at least one resistive element (not shown) such as a resistor, coupled in series to the light-emitting elements 201*a* and 202*a*, that controls or limits current through the light-emitting device 20*a*.

Figure 2B:
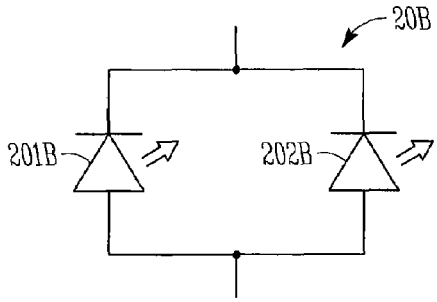

FIG. 2*b* shows an embodiment of a light-emitting device 20*b* comprising two light-emitting elements 201*b* and 202*b*, such as light-emitting diodes. The light-emitting elements 201*b* and 202*b* are coupled in parallel. If the light-emitting elements 201*b* and 202*b* are light-emitting diodes, n-side terminals of the light-emitting diodes are coupled together, and p-side terminals of the light-emitting diodes are coupled together. The light-emitting device 20*b* may further comprise at least one resistive element (not shown), such as a resistor, coupled in series to the light-emitting elements 201*b* and 202*b*, that controls or limits current through light-emitting elements.

Figure 2C:
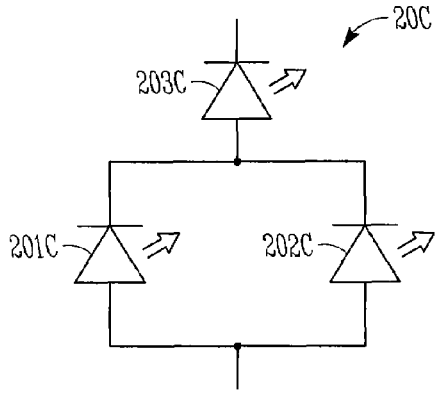

FIG. 2*c* shows an embodiment of a light-emitting device 20*c* comprising light-emitting elements 201*c*, 202*c* and 203*c*, such as light-emitting diodes. Light-emitting elements 201*c* and 202*c* are coupled in parallel. If the light-emitting elements 201*c* and 202*c* are light-emitting diodes, n-side terminals of the light-emitting diodes are coupled together, and p-side terminals of the light-emitting diodes are coupled together. The light-emitting device 203*c* is coupled in series to the parallel-coupled light-emitting elements 201*c* and 202*c*. If the light-emitting elements 201*c*, 202*c* and 203*c* are light-emitting diodes, a p-side terminal of the light-emitting diode 203*c* is coupled to the n-side terminals of light-emitting diodes 201*c* and 202*c*. In some embodiments, an n-side terminal of the light-emitting diode 203*c* is coupled to the p-side terminals of the light-emitting diodes 201*c* and 202*c* (not shown). In some embodiments, the light-emitting device 20*c* further comprises at least one resistive element (not shown), such as a resistor, coupled in series to the light-emitting elements 201*c*, 202*c* and 203*c*, that controls or limits current through the light-emitting elements.

Figure 2D:
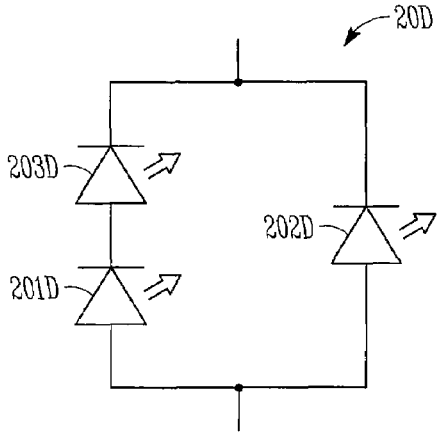

FIG. 2*d* shows embodiments of a light-emitting device 20*d* comprising light-emitting elements 201*d*, 202*d* and 203*d*, such as light-emitting diodes. Light-emitting element 201*d* is coupled in series to light-emitting element 202*d*. If the light-emitting elements 201*d* and 202*d* are light-emitting diodes, a p-side terminal of light-emitting diode 201*d* is coupled to an n-side terminal of the light-emitting diode 202*d*. Light-emitting element 203*d* is coupled in parallel to the serial-coupled light-emitting elements 201*d* and 202*d*. For light-emitting diodes an n-side terminal of the light-emitting 203*d* is coupled to n-side terminal of light-emitting diode 201*d*, and a p-side terminal of light-emitting diode 203*d* is coupled to the p-side terminal of the light-emitting diode 202*d*. If the light-emitting elements 201*d*, 202*d* and 203*d* are light-emitting diodes, a p-side terminal of light-emitting diode 201*d* is coupled to an n-side terminal of light-emitting diode 202*d*. In some embodiments, the light-emitting device 20*d* may further comprise at least one resistive element (not shown), such as a resistor, coupled in series to the light-emitting elements 201*d*, 202*d* and 203*d*, that controls or limits current through the light-emitting elements.

Figure 3A:
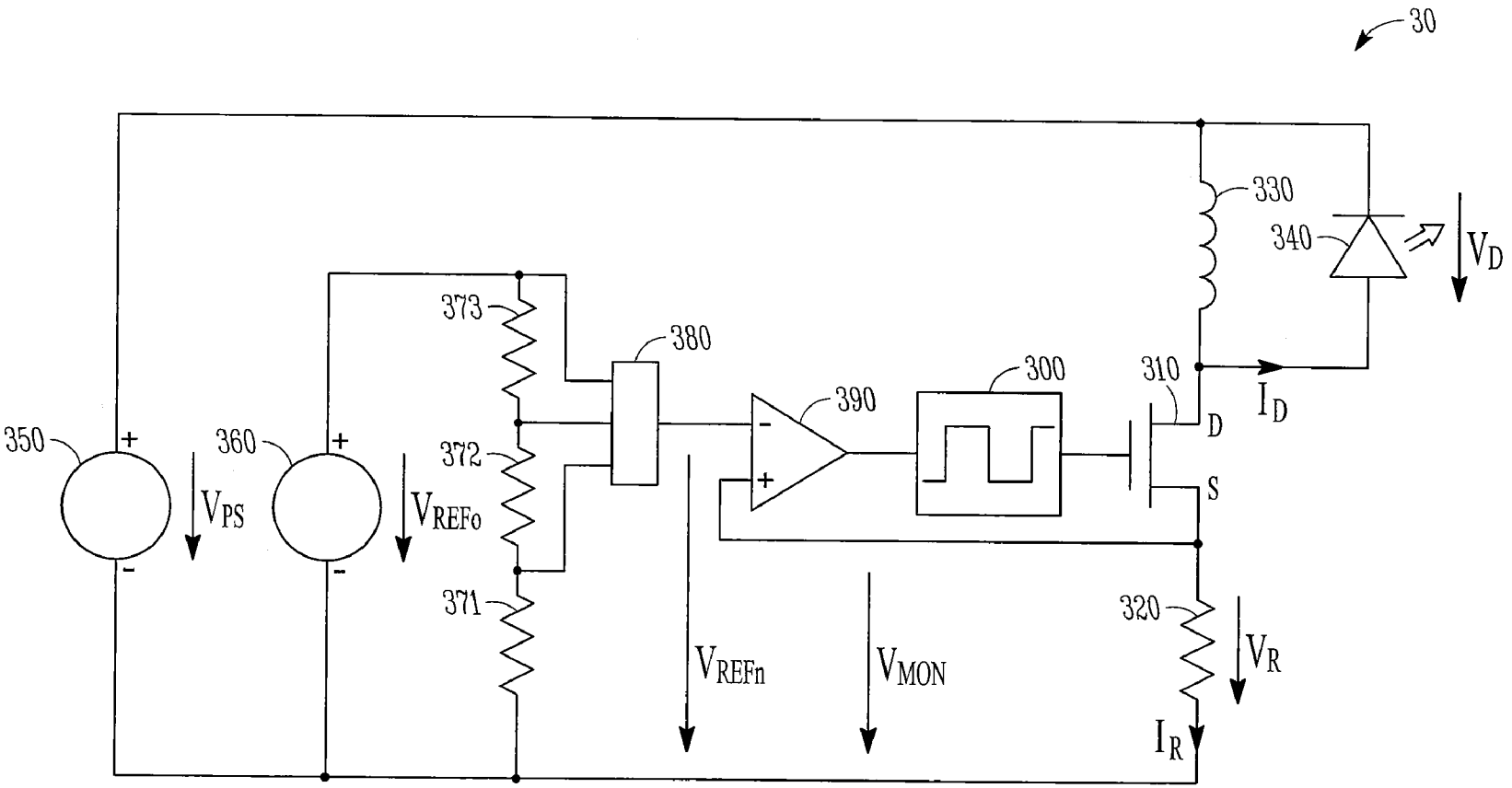
FIG. 3*a* shows a schematic diagram of another embodiment of the invention.

FIG. 3*a* shows apparatus 30 in accordance with another embodiment of the invention. Apparatus 30 comprises a signal generator 300, a transistor 310, such as an n-channel FET having a source S, a drain D and a gate G, a resistive element 320, an inductive element 330, a light-emitting device 340, a reference supply 360, a voltage divider 370 having voltage-divider resistive elements 371, 372, 373, a selecting element 380, and a comparing element 390. Apparatus 30 is coupled to a power supply 350. In some embodiments, the power supply 350 may be a mains adapter, a battery or a rechargeable battery. The power supply 350 provides a supply voltage $V_{PS}$ between a positive terminal (+) and negative terminal (−). Thus, the power supply 350 provides a direct current (DC). The inductive element 330 is coupled in parallel to the light-emitting device 340. An output of the signal generator 300 is coupled to the gate G of the transistor 310. The drain D of the transistor 310 is coupled to the parallel-coupled inductive element 330 and light-emitting device 340. The source S of the transistor 310 is coupled to the resistive element 320, and a non-inverting input of the comparing element 390 is coupled to the source S of transistor 310 providing the comparing element 390 with a monitoring voltage $V_{MON}$ representing a voltage $V_R$ generated by a supply current $I_R$ flowing through the resistive element 320. An inverting input of the comparing element 390 provides a reference voltage $V_{REFn}$ to the comparing element 390. An output of the comparing element 390 is coupled to an input of the generator 300. The inverting input of the comparing element 390 is coupled to an output of the selector 380.

In some embodiments, the inverting input of the comparing element 390 may be directly coupled to the reference supply 360. In some embodiments, the inputs of the selecting element 380 carry different reference supply voltage levels. In some embodiments, the inputs of the selecting element 380 may be coupled to different terminals of the voltage divider 370, and the reference voltage $V_{REFn}$ is selected by the selecting element SEL 380. In some embodiments, the voltage-divider resistive elements 371, 372, 373 may have same values, different values, variable values and/or adjustable values. In some embodiments, an implementation of the voltage-divider resistive elements 371, 372, 373 may utilize fuses, such as e-fuses or laser fuses.

An input of the voltage divider 370 may be coupled to the reference supply REF0. The reference supply REF0 generates a reference voltage $V_{REF0}$, that may be divided by voltage divider 370. In some embodiments, an implementation of reference supply and reference processing utilizes a current source, for example. In some embodiments, the resistive element R 320 is implemented as a voltage divider having voltage-divider resistive elements having same values, different values, variable values and/or adjustable values.

During duration of an on-time, $T_1$, of the signal generator 300, the apparatus 30 is in a charge state during which the inductive element 330 is charged. When the monitoring voltage $V_{MON}$, that increases during the charge state, reaches the reference voltage $V_{REFn}$, the comparing element 390 switches the generator 300 from the on-time to an off-time, and the duration of the off-time, $T_2$, controls the discharge state during which the inductive element 330 is discharged through the light-emitting device 340. A voltage across the light-emitting device 340, $V_D$, that is reversed during the discharge state, results in a current through the light-emitting device 340, $I_D$.

Figure 3B:
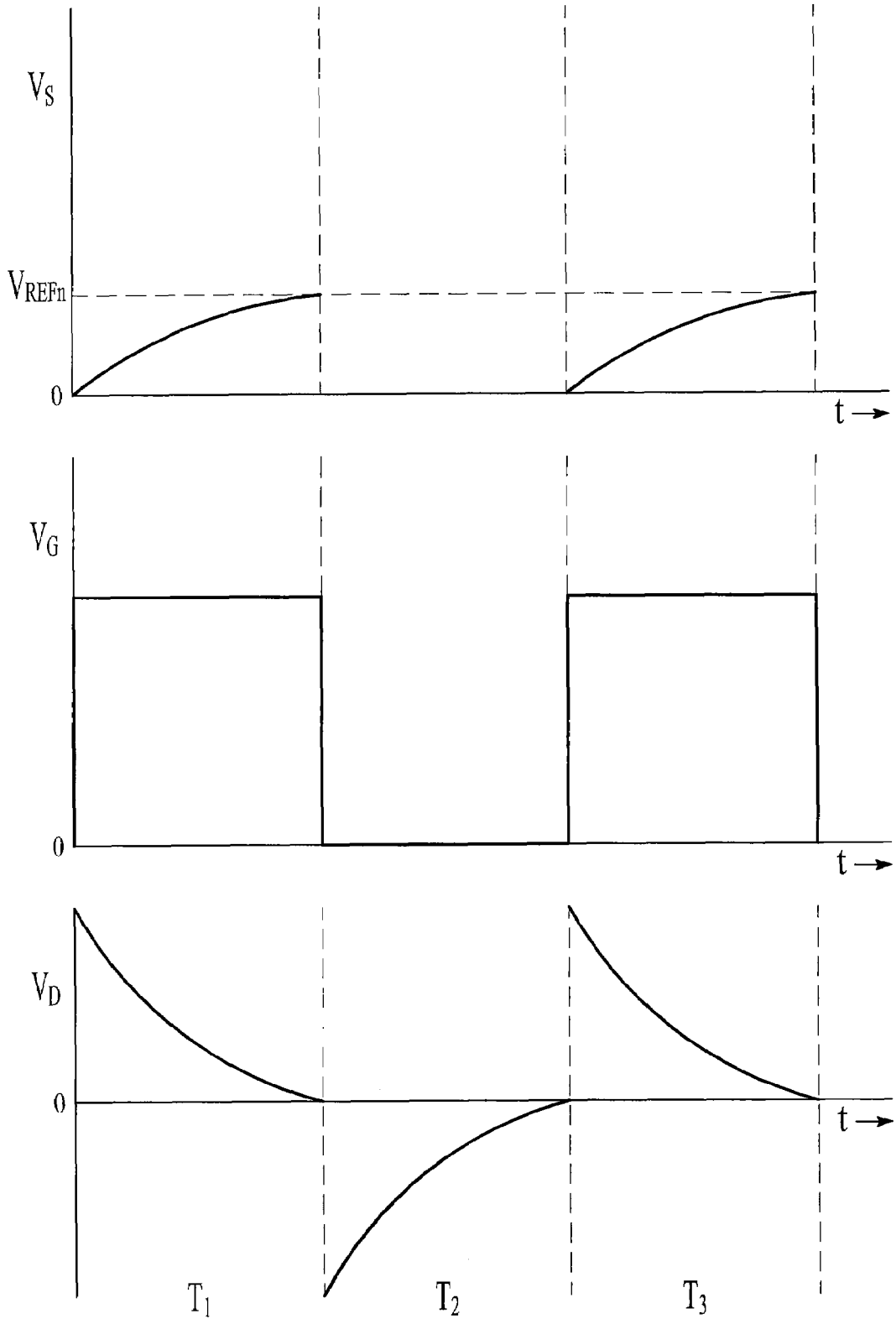
FIG. 3*b* shows time-domain representations of several signals for the embodiment shown in FIG. 3*a;*

FIG. 3*b* shows time-domain representations of signals for the embodiment of the invention shown in FIG. 3*a*. Each of the representations accommodates durations of a charge state, a discharge state and a subsequent charge state.

A representation situated in a top portion of the FIG. 3*b* shows the voltage $V_R$ across the resistive element 320, representing the supply current $I_R$ During the charge state voltage $V_R$ increases as the inductive element 330 is charged. As the voltage $V_R$ reaches the level of the reference voltage $V_{REFn}$, the voltage $V_R$ representing supply current $I_R$ drops to 0 for the duration of the discharge state, as transistor 310 is switched off.

A representation situated in a middle portion of FIG. 3*b* shows the gate voltage $V_G$ controlling the transistor 310. During the charge state the gate voltage $V_G$ is high, and, thus, the transistor 310 is switched on. At the end of the charge state the gate voltage $V_G$ decreases, that is drops, and transistor 310 is switched off for the duration of the discharge state. During the discharge state, the gate voltage $V_G$ may or may not equal 0, as long as it is ensured that the transistor 310 is switched off.

A representation situated in a bottom portion of the FIG. 3*b* shows the voltage across light-emitting device, $V_D$. During the charge state the voltage across the light-emitting device, $V_D$, is positive. However, the current through the light-emitting device 340, $I_D$, is 0 or close to 0, as the light-emitting device 340 is in reverse order. During the discharge state the inductive element L 330 is discharged through the light-emitting device 340 as the current $I_D$ flows through the light-emitting device 340. The negative voltage across light-emitting device 340, $V_D$, increases towards 0. The voltage $V_D$ may or may not reach 0 at the end of the discharge state dependent on the duration of the discharge state.

Figure 4:
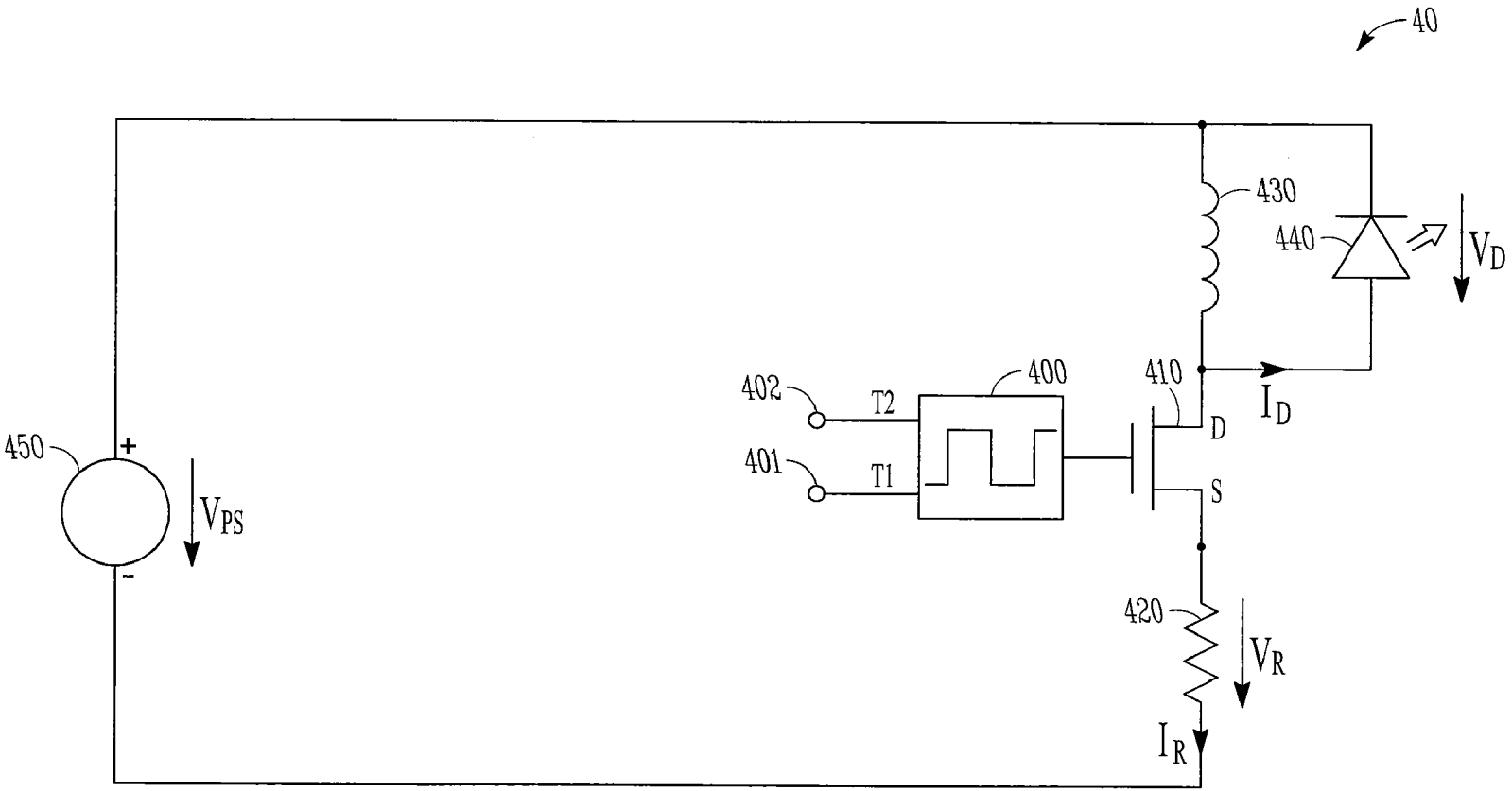
FIG. 4 shows a schematic diagram of yet another embodiment of the invention.

FIG. 4 shows apparatus 40 in accordance with yet another embodiment of the invention. The apparatus 40 comprises a signal generator 400, a transistor 410 having a source S, a gate G and a drain D, an inductive element 430 and a light-emitting device 440. In some embodiments, the apparatus 40 further comprises a resistive element 420, such as a resistor or shunt. The apparatus 40 is coupled to a power supply 450 as discussed with reference to FIG. 1. The inductive element 430 is coupled in parallel to the light-emitting device 440. The inductive element 430 and the light-emitting device 440 are coupled to the power supply 450, for example to the positive terminal (+), and to the drain D of the transistor 410. The source S of the transistor 410 may be coupled to the power supply 450, for example to the negative terminal (−), or may be coupled to the power supply 450 via the resistive element 420. An output of the signal generator 400 is coupled to the gate G of the transistor 410 to switch it repeatedly between a charge state during which the inductive element 430 is charged and a discharge state during which the inductive element 130 is discharged through the light-emitting device 440. The signal generator 400 comprises an on-time input 401 for controlling duration $T_1$ of the on-time of the signal generator 400 and an off-time input 402 for controlling duration $T_2$ of the off-time of the signal generator 400. As an average current through the light-emitting device 440, $I_{D_average}$, also depends on the duration $T_1$ of the on-time and the duration $T_2$ of the off-time, durations $T_1$ and $T_2$ may be used as parameters for controlling the current $I_{D_average}$.

With regard to the on-time duration $T_1$ and the off-time duration $T_2$ several configuration embodiments are possible, including, for example, variable on-time duration $T_1$ and constant off-time duration $T_2$, variable on-time duration $T_1$ and variable off-time duration $T_2$, variable on-time duration $T_1$ and off-time duration $T_2$ as a function of on-time duration $T_1$, and variable on-time duration $T_1$ and off-time duration $T_2$ as a function of on-time duration $T_1$, supply voltage $V_{PS}$ and light-emitting device voltage $V_D$, as discussed with reference to FIG. 5.

FIG. 5 shows schematic diagrams of configuration embodiments of on-time generators and off-time generators.

Figure 5A:
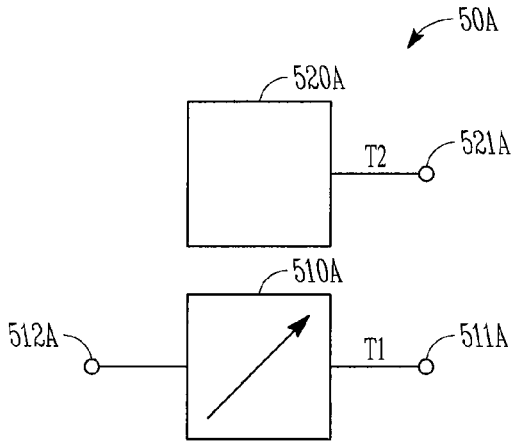
FIG. 5*a* shows a schematic diagram of a configuration of a variable on-time generator and a constant off-time generator.

FIG. 5*a* shows a schematic diagram of a configuration 50*a* comprising a variable on-time generator 510*a* and a constant off-time generator 520*a*. The on-time generator 510*a* comprises an output 511*a* to provide an on-time of variable duration $T_1$ that may be coupled to the on-time input 401 shown in FIG. 4, and, in some embodiments, further comprises an input 512*a* to control the variable duration $T_1$. Off-time generator 420*a* comprises an output 521*a* to provide an off-time of fixed duration $T_2$ that may be coupled to the off-time input 402 shown in FIG. 4.

Figure 5B:
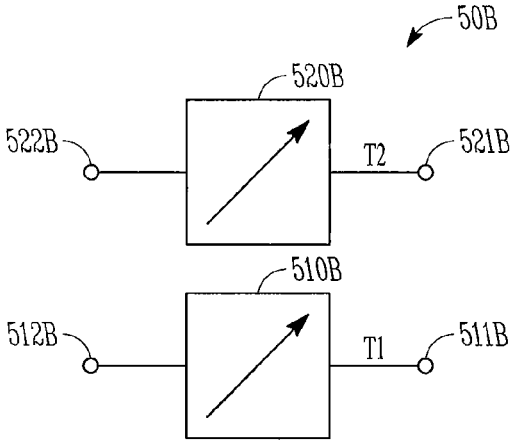
FIG. 5*b* shows a schematic diagram of a configuration of a variable on-time generator and a variable off-time generator.

FIG. 5*b* shows a schematic diagram of some embodiments of a configuration 50*b* comprising a variable on-time generator 510*b* and a variable off-time generator 520*b*. The on-time generator 510*b* comprises an output 511*b* to provide an on-time of variable duration $T_1$ that may be coupled to the on-time input 401 shown in FIG. 4, and, in some embodiments, may further comprise an input 512*b* to control the variable duration $T_1$. The off-time generator 520*b* comprises an output 521*b* to provide an off-time of variable duration $T_2$ that may be coupled to the off-time input 402 shown in FIG. 4, and may further comprise an input 522*b* to control the variable duration $T_2$.

Figure 5C:
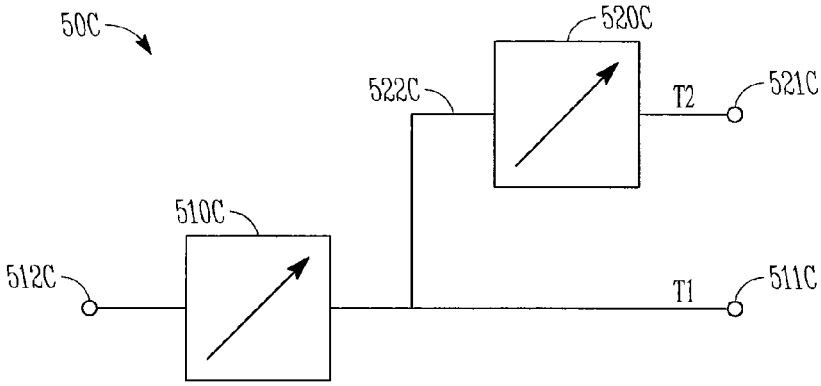
FIG. 5*c* shows a schematic diagram of a configuration of an on-time generator and a dependent off-time generator.

FIG. 5*c* shows a schematic diagram of embodiments of a configuration 50*c* comprising a variable on-time generator 510*c* and a dependent controllable off-time generator 520*c*. The on-time generator 510*c* comprises an output 511*c* to provide an on-time of variable duration $T_1$ that may be coupled to on-time input 401 shown in FIG. 4, and may further comprise an input 512*c* to control the variable duration $T_1$. The off-time generator 520*c* comprises an output 521*c* to provide an off-time of variable duration $T_2$ that may be coupled to the off-time input 402 shown in FIG. 4, and an input 522*c* coupled to the output 511*c* of the on-time generator 510*c*. Thus, off-time duration $T_2$ depends on the on-time duration $T_1$:

$$T_2=f(T_1). \tag{1}$$

The variable on-time duration $T_1$, that may be measured, and the dependent off-time duration $T_2$ may be used to achieve a constant average current through the light-emitting device, $I_{D_average}$.

Figure 5D:
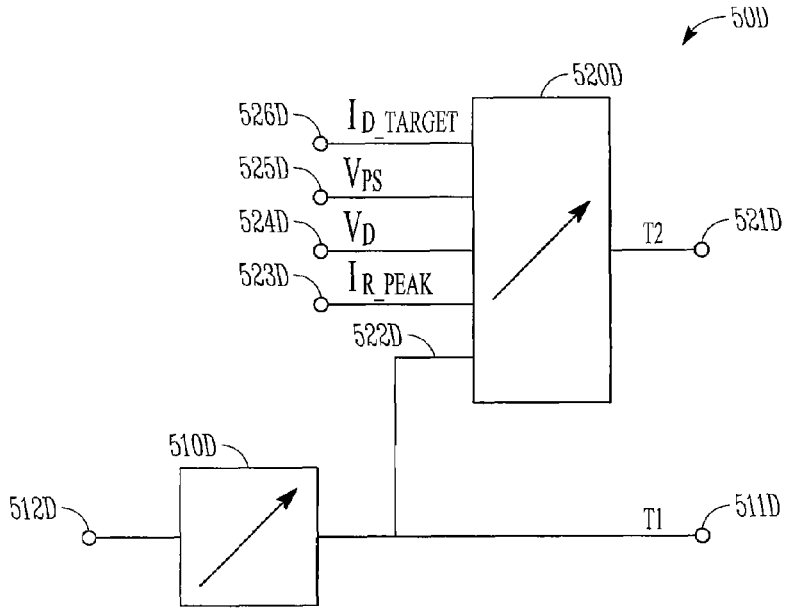
FIG. 5*d* shows a schematic diagram of a configuration of a variable on-time generator and a dependent controllable off-time generator.

FIG. 5*d* shows a schematic diagram of embodiments of a configuration 50*d* comprising a variable on-time generator 510*d* and a dependent controllable off-time generator 520*d*. The on-time generator 510*d* comprises an output 511*d* to provide an on-time of variable duration $T_1$ that may be coupled to the on-time input 401 shown in FIG. 4, and in some embodiments comprises an input 512*d* to control the on-time duration $T_1$. The off-time generator 520*d* comprises an output 521*d* to provide an off-time of variable duration $T_2$ that may be coupled to the off-time input 402 shown in FIG. 4, and an input 522*d* coupled to the output 511*d* of the on-time generator 510*d*. The off-time generator 520*d* may further comprise an input 523*d* to receive the peak supply current $I_{R_peak}$ or information thereon, an input 524*d* to receive the light-emitting device voltage $V_D$ or information thereon, an input 525*d* to receive the supply voltage $V_{PS}$ or information thereon, and an input 526*d* to receive a target current through the light-emitting device, $I_{D_target}$, or information thereon. The off-time duration $T_2$ depends on the on-time duration $T_1$, supply voltage $V_{PS}$, peak supply current $I_{R_peak}$, light-emitting device voltage $V_D$ and the target current through the light-emitting device, $I_{D_target}$:

$$T_2=f(T_1,V_{PS},I_{R_peak},V_D,I_{D_target}). \tag{2}$$

Figure 5E:
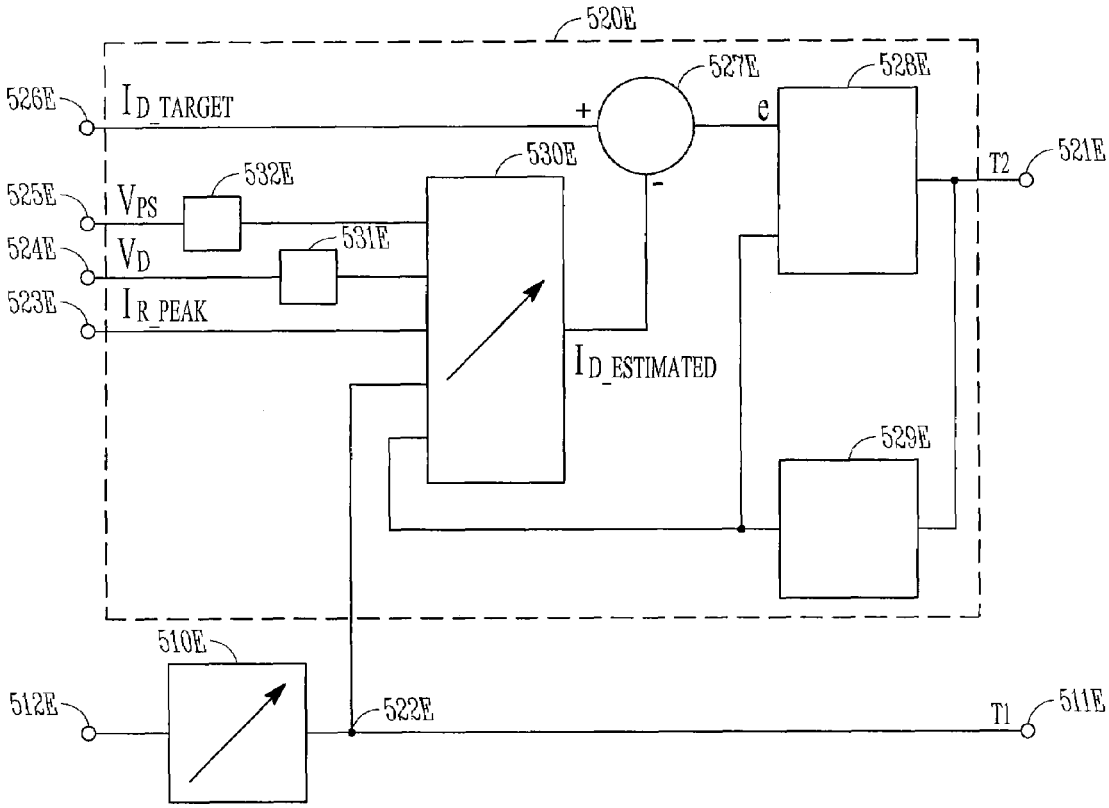
FIG. 5*e* shows a block diagram of the configuration shown in FIG. 5*d;*

FIG. 5*e* shows a block diagram of some embodiments of 520*d* shown in FIG. 5*d*, comprising an on-time generator 510*e* that corresponds with the on-time generator 510*d* and an off-time generator 520*e* that corresponds with the off-time generator 520*d*. The off-time generator 520*e* comprises a subtracting element 527*e*, a controlling element 528*e*, such as a controller, a measuring element 529*e* and an estimating element 530*e*, such as an estimator, forming a control circuit. An input of the measuring element 529*e* is coupled to an output 521*e* of the off-time generator 520*e*. The measuring element 529 measures off-time duration $T_2$. The estimating element 530*e* comprises a first input coupled to an output of the measuring element 529*e* to receive the off-time duration $T_2$, a second input coupled to the input 522*e* of the off-time generator 520*e* to receive the on-time duration $T_1$, a third input coupled to an input 523*e* of the off-time generator 520*e* to receive the peak supply current $I_{R_peak}$, a fourth input coupled to input 524*e* of the off-time generator 520*e* to receive the light-emitting device voltage $V_D$, and a fifth input coupled to input 525*e* of the off-time generator 520*e* to receive the supply voltage $V_{PS}$. The off-time generator 520*e* may comprise a first analog-to-digital converter (ADC) 531*e* coupled between the input 524*e* of the off-time generator 520*e* and the forth input of the estimating element 530*e* to convert the light-emitting device voltage $V_D$ into a digital signal. The off-time generator 520*e* may further comprise a second ADC 532*e* coupled between the input 525*e* of the off-time generator 520*e* and the fifth input of the estimating element 530*e* to convert the supply voltage $V_{PS}$ into a digital signal. However, since computer systems and other electronic systems increasingly monitor internal conditions, including supply voltage, a digital signal representing the supply voltage $V_{PS}$ may be readily available. The subtracting element 527*e* comprises a non-inverting input coupled to input 526*e* of the off-time generator 520*e* to receive the target average current though the light-emitting device, $I_{D_target}$, and an inverting input coupled to an output of the estimating element 530*e* to receive an estimated current through the light-emitting device, $I_{D_estimated}$. The subtracting element 527*e* determines an error signal e by subtracting the estimated current through light-emitting device, $I_{D_estimated}$, from the target average current through light-emitting device, $I_{D_target}$. The controlling element 528*e* comprises a first input coupled to an output of the subtracting element 527*e* to receive the error signal e, and a second input coupled to the output of the measuring element 529*e* to receive the off-time duration $T_2$. An output of the controlling element 528*e* is coupled to the output 521*e* of the off-time generator 520*e*. The control circuit may be implemented as time-continuous circuit or time-discrete circuit. The control circuit may operate with continues signal values, discrete signal values and/or digital signal values.

The average current through the light-emitting device, $I_{D_average}$, may be described by:

$$I_{D_average}=f(T_1,T_2,V_{PS},I_{R_peak},V_D,L) \tag{3}$$

where $T_1$ is the on-time duration, that is charge state duration, $T_2$ is the off-time duration, that is discharge state duration, $V_{PS}$ is the supply voltage, $I_{R_peak}$ is the peak supply current, $V_D$ is the light-emitting device voltage, and L is the inductance of the inductive element.

For $T_2=f(T_1)$ the average current through the light-emitting device may be described by:

$$I_{D_average}=f(T_1,V_{PS},I_{R_peak},V_D,L). \tag{4}$$

In some embodiments, a discrete-time control circuit may control the average current through the light-emitting device, $I_{D_average}$. The estimating element 530*e* estimates the average current through the light-emitting device based on discrete-time samples of the on-time duration $T_1$ and off-time duration $T_2$. The estimated average current through the light-emitting device, $I_{D_estimated}$, may be described by:

$$I_{\mathrm{D_estimated}}(k)=\left(I_{\mathrm{R_peak}}-\frac{T_2(k-1)V_D}{2L}\right)\frac{T_2(k-1)}{T_1(k)+T_2(k-1)} \tag{5}$$

where (k) denotes current signal samples, and (k−1) denotes samples from a previous switching period.

Subtracting element 527*e* determines an error signal e(k):

$$e(k)=I_{D_error}(k)=I_{D_target}(k)-I_{D_estimated}(k). \tag{6}$$

In some embodiments, the target average current through the light-emitting device, $I_{D_target}$ may be constant, or may be changed over time, for example for changing illumination.

The controlling element 528*e* determines a current value for the off-time duration $T_2(k)$, that is used to control off-time duration of the generator SG. Thus, the off-time duration $T_2(k)$ is used to generate a pulse-width-modulated (PWM) signal, that causes the average current through the light-emitting device, $I_{D_average}$. The controlling element 528*e* may be a proportional-integral (PI) controller $$T_2(k)=T_2(k-1)-\text{constant}\ I_{D_error}(k). \tag{7}$$

In some embodiments, the controlling element 528*e* is a proportional-integral-derivative (PID) controller or controller of another type. In some embodiments, the control circuit also compensates for variations of the supply voltage $V_{SP}$, thus, increasing a power-supply-rejection.

Figure 6:
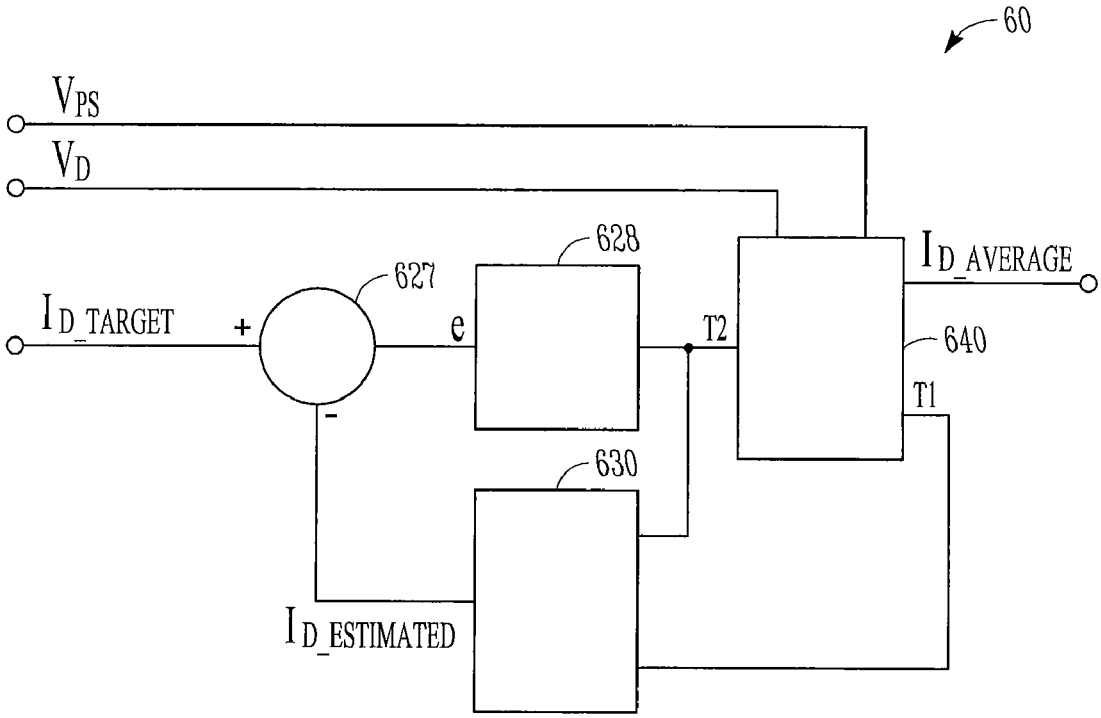
FIG. 6 shows a schematic diagram of a control system according to the embodiment of the invention shown in FIG. 4.

FIG. 6 shows a schematic diagram of a control system 60 according to some embodiments of the invention shown in FIG. 4. The control system 60 comprises a subtracting element 627, a controlling element 628, an estimator 630 and a light-emitting system 640, such as apparatus 10, 40 or 90. The light-emitting system 640 has a supply voltage $V_{PS}$, a light-emitting device voltage $V_D$ and an off-time duration $T_2$. The light-emitting system 640 has an average current through the light-emitting device, $I_{D_average}$, and an on-time duration $T_1$. The estimator 630 is coupled to the controlling element 628 to receive the off-time duration $T_2$, and to the light-emitting system 640 to receive the on-time duration $T_1$. The estimator 630 generates an estimated value for the current through the light-emitting device, $I_{D_estimated}$, from the on-time duration $T_1$ and the off-time duration $T_2$. The subtracting element 627 receives a target current through the light-emitting device, $I_{D_target}$, and is coupled to the estimator 630 to receive the estimated current through the light-emitting device, $I_{D_estimated}$. The subtracting element 627 generates an error signal e by subtracting the estimated current through the light-emitting device, $I_{D_estimated}$, from the target current through the light-emitting device, $I_{D_target}$. The controlling element 628 is coupled to the subtracting element 627 to receive the error signal e, the controlling element 628 determines the off-time duration $T_2$. The controlling element 628 may be a proportional-integral (PI) controller, a proportional-integral-derivative (PID) controller, or controller of another type.

FIG. 7 shows representations of control ranges of on-time duration $T_1$ and off-time duration $T_2$ for different peak supply currents $I_{R_peak}$ and different light-emitting device voltages $V_D$.

Figure 7A:
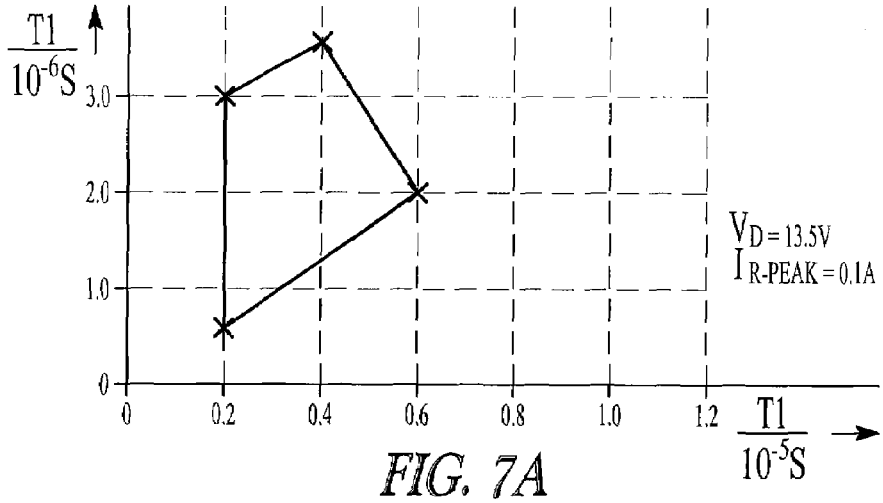
FIGS. 7*a* to 7*c* show representations of control ranges for on-time duration $T_1$ and off-time $T_2$ for different peak supply currents $I_{R_peak}$ and different light-emitting device voltages $V_D$.

FIG. 7*a* shows a field of on-time-duration/off-time-duration ($T_1/T_2$) pairs for light-emitting device voltage $V_D$=13.5 V, that corresponds with an on-voltage of three in series coupled white LEDs, and a peak supply current $I_{R_peak}$=0.11 A.

Figure 7B:
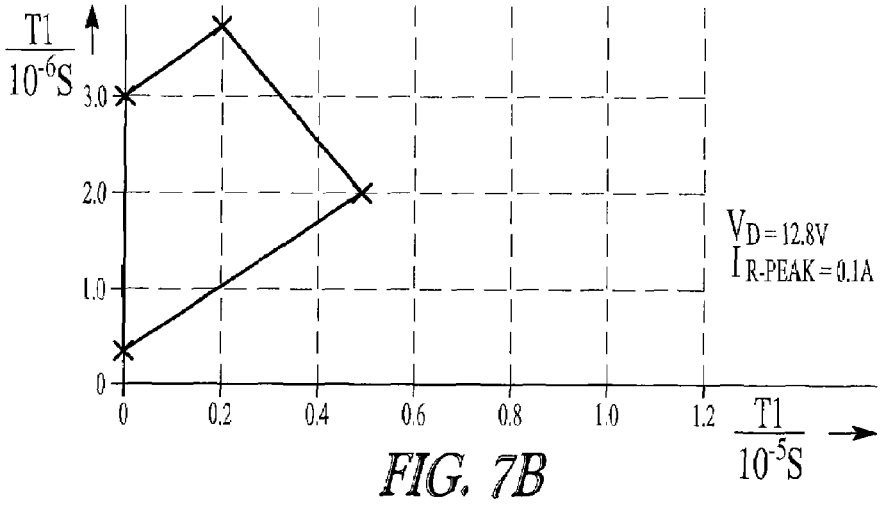

FIG. 7*b* shows a field of on-time-duration/off-time-duration ($T_1/T_2$) pairs for light-emitting device voltage $V_D$=12.8 V, that corresponds with a different on-voltage of three in series coupled white LEDs and, a peak supply current $I_{R_peak}$=0.1 A.

Figure 7C:
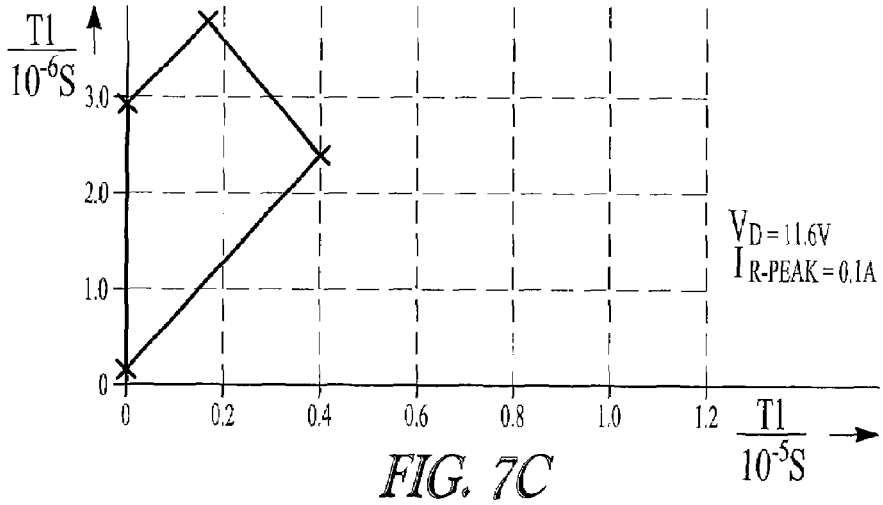

FIG. 7*c* shows a field of on-time-duration/off-time-duration ($T_1/T_2$) pairs for light-emitting device voltage $V_D$=11.6 V, that corresponds with an on-voltage of three in series coupled blue LEDs, and a peak supply current $I_{R_peak}$=0.1 A.

While a constant average current through the light-emitting device may result in constant illumination of the light-emitting device, changing the average current through the light-emitting device over time changes illumination of the light-emitting device. In a user interface of a computer system or other electronic system illumination may be changed for several reasons, for example, illumination may be reduced in order to reduce power consumption preferably when it is not required, or illumination may be increased in order to attract attention of a user. Furthermore, illumination may be turned on for use of the user interface, and may be turned off after use optionally with a delay.

FIG. 8 shows time-domain representations of on-time durations $T_1$ and off-time durations $T_2$ during dim-on and dim-off operations.

Figure 8A:
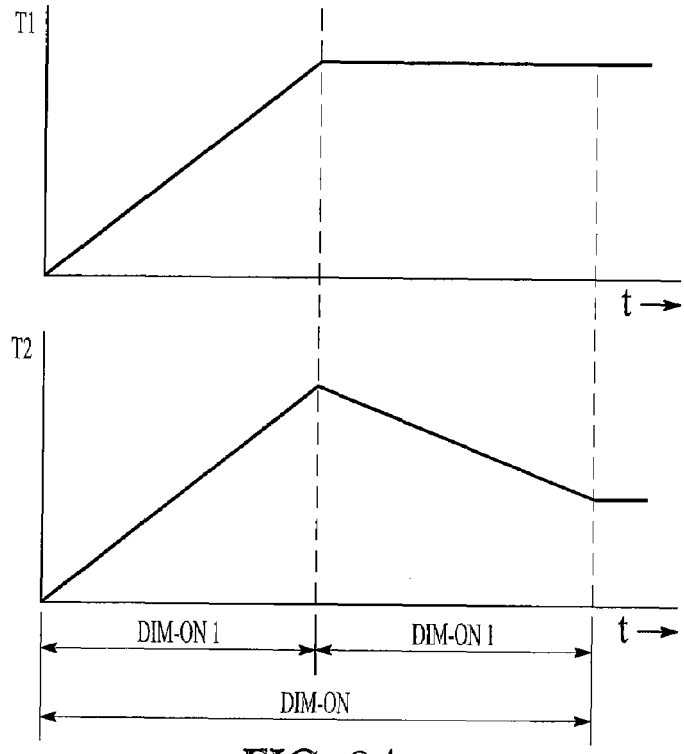
FIG. 8*a* shows time-domain representations of an on-time duration $T_1$ and an off-time duration $T_2$ for increasing light emission from 0 during a dim on operation.

FIG. 8*a* shows time-domain representations of an on-time duration $T_1$ and an off-time duration $T_2$ for light emission increasing from 0 during a dim-on operation. Dim-on comprises a first period dim-on1 of duration $T_{dim\text{-}on1}$ and a subsequent period dim-on2 of duration $T_{dim\text{-}on2}$. The durations $T_{dim\text{-}on1}$ and $T_{dim\text{-}on2}$ may or may not be of equal length. During the period dim-on1 the on-time duration $T_1$ and off-time duration $T_2$ increase from 0 to predetermined values of $T_1$ and $T_2$, respectively, thus, increasing average current through the light-emitting device and, therefore, illumination. During the period dim-on1 the off-time duration $T_2$ may be equal to the on-time duration $T_1$:

$$T_2(t)=T_1(t). \tag{8}$$

During the period dim-on2 the on-time duration $T_1$ is constant or controlled by the on-time generator, and the off-time duration $T_2$ decreases to a target value, thus, further increasing average current through the light-emitting device and, therefore, illumination.

Figure 8B:
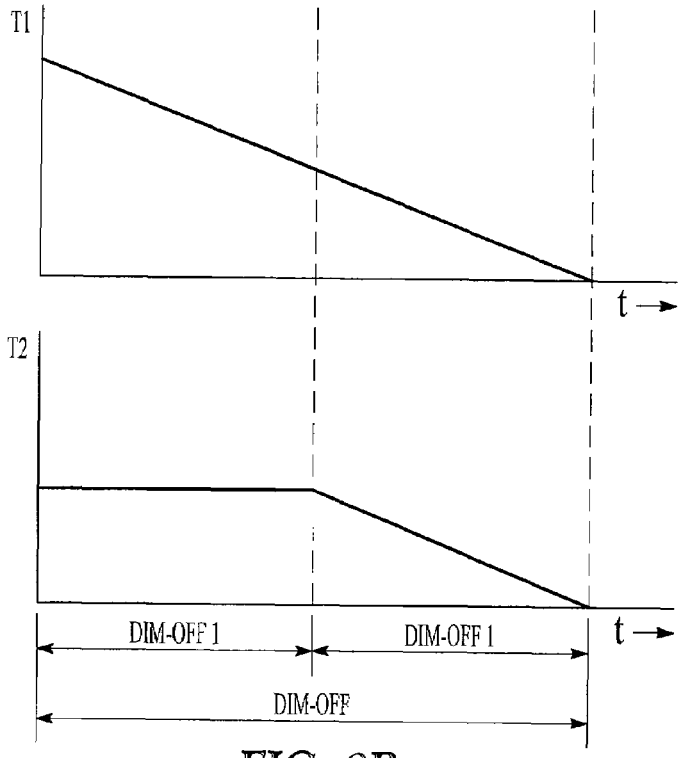
FIG. 8*b* shows time-domain representations of an on-time duration $T_1$ and an off-time duration $T_2$ for decreasing light emission to 0 during a dim-off operation.

FIG. 8*b* shows time-domain representations of an on-time duration $T_1$ and an off-time duration $T_2$ for light emission decreasing to 0 during a dim-off operation. Dim-off comprises a first period dim-off1 of duration $T_{dim\text{-}off1}$ and a subsequent period dim-off2 of duration $T_{dim\text{-}off2}$. The durations $T_{dim\text{-}off1}$ and $T_{dim\text{-}off2}$ may or may not be of equal length. During the period dim-off1 the off-time duration $T_2$ is constant and the on-time duration $T_1$ decreases to a value of the off-time duration $T_2$, thus, decreasing average current through the light-emitting device and, therefore, illumination.

During the period dim-off2 the on-time duration $T_1$ and off-time duration $T_2$ decrease to 0, thus, surceasing average current through the light-emitting device and, therefore, illumination. During the period dim-off2 the off-time duration $T_2$ may be equal to the on-time duration $T_1$:

$$T_2(t)=T_1(t). \tag{9}$$

Figure 9:
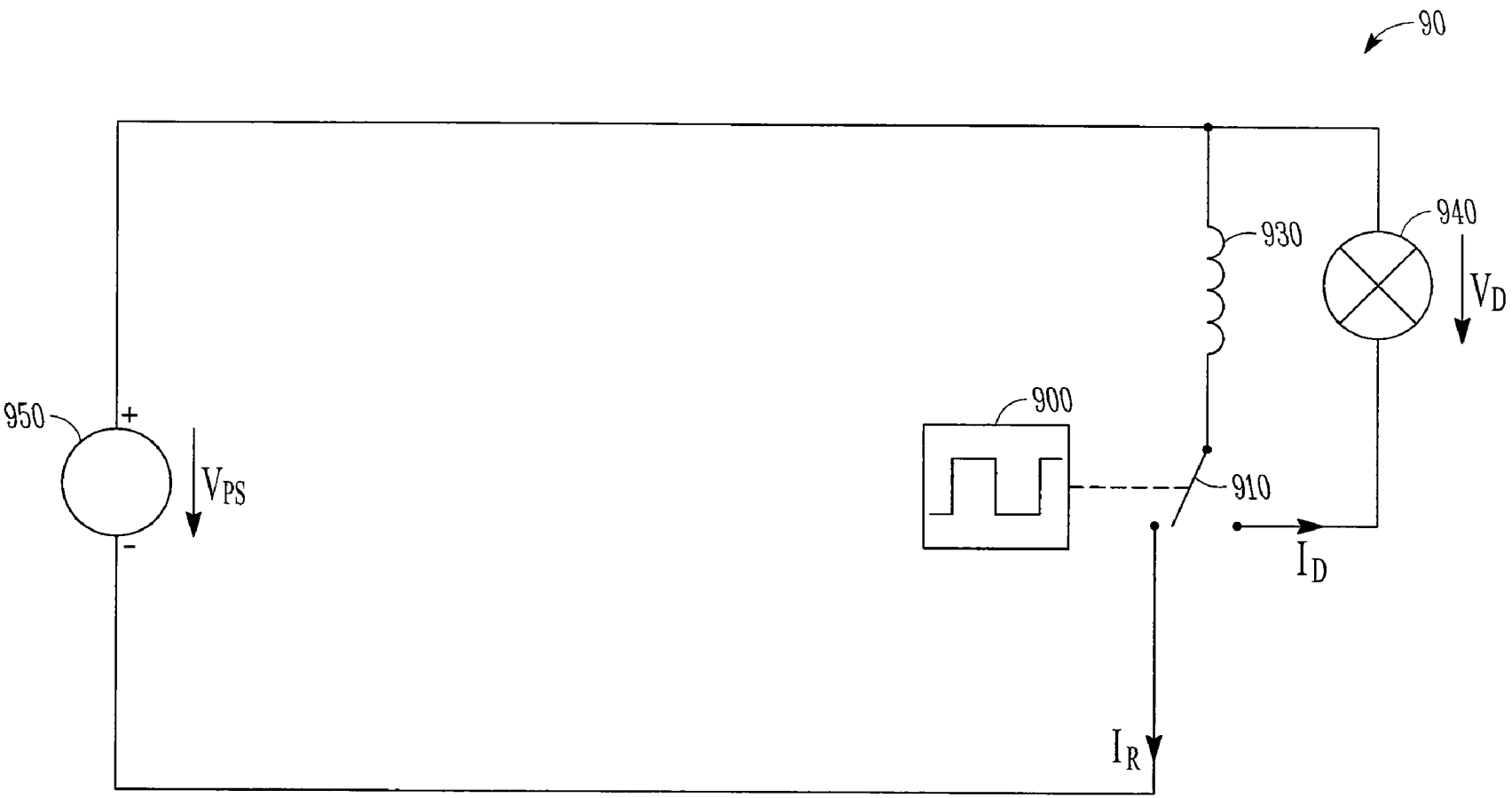
FIG. 9 shows a schematic diagram of a further embodiment of the invention.

FIG. 9 shows apparatus 90 in accordance with a further embodiment of the invention. The apparatus 90 provides illumination for the computer system or the electronic system, and comprises a signal generator 900, a switching element 910, an inductive element 930 and a light-emitting device 940 as discussed with reference to FIG. 1. The apparatus 90 is coupled to a power supply 950 as discussed with reference to FIG. 1. A first terminal of the inductive element L 930 and a first terminal of the light-emitting device 940 are coupled to a first terminal of the power supply PS 950. A second terminal of the inductive element 930 is coupled to a first terminal of the switching element 910. A second terminal of the light-emitting device D 940 is coupled to a second terminal of the switching element S 910. A third terminal of the switching element 910 is coupled to a second terminal of the power supply PS 950. The signal generator 900 is coupled to the switching element 910 to switch it repeatedly between a charge state during which the switching element 910 couples its first terminal to its third terminal and, thus, the inductive element 930 is charged and a discharged state during which the switching element 910 couples its first terminal to its second terminal and, thus, the inductive element 930 is discharged through the light-emitting device D 940. In some embodiment, signal generator 900 is a signal generator as discussed with reference to FIG. 1. The switching element 910 may be implemented as a switch or transistor as discussed with reference to FIG. 1, or transistors that may be controlled with a phase of 180 degree. The light-emitting device 940 may comprise a light-emitting diode (LED) as discussed with reference to FIG. 1. Alternatively, the light-emitting device 940 may comprise a unidirectional device, such as a bulb.

Owing to variations in production, on-voltage of light-emitting devices may vary from device to device. Embodiments of the invention may reduce effects of these variations. Magnitude of the on-voltage of the light-emitting device, $V_{on}$ may be determined by:

$$V_{on} = \frac{T_1}{T_2}|V_{PS}| \tag{10}$$

where $T_2$ is a fixed off-time duration, $T_1$ is a corresponding on-time duration, that may be determined or measured, and $V_{PS}$ is the supply voltage.

Although specific embodiments have been illustrated and described herein, it will be appreciated by those of ordinary skill in the art, that any arrangement which is calculated to achieve the same purpose may be substituted for the specific embodiments shown. It is to be understood, that the above description is intended to be illustrative and not restrictive. This application is intended to cover any adaptations or variations of the invention. Combinations of the above embodiments and many other embodiments will be apparent to those of skill in the art upon reading and understanding the above description. The scope of the invention includes any other embodiments and applications in which the above structures and methods may be used. The scope of the invention should, therefore, be determined with reference to the appended claims along with the full scope of equivalents to which such claims are entitled.

It is emphasized that the Abstract is provided to comply with 37 C.F.R. section 1.72(b) requiring an abstract that will allow the reader to quickly ascertain the nature and gist of the technical disclosure. It is submitted with the understanding, that it will not be used to interpret or limit the scope or meaning of the claims.

What is claimed is:

1. An apparatus, comprising:

a unidirectionally conductive light-emitting device;

an inductive element coupled in parallel to said light-emitting device;

a switching element to conduct current from a power supply through said inductive element during an on-time interval and an off-time interval during which said inductive element is discharged through said light-emitting device; and a signal generator coupled to said switching element to switch it between the on-time interval and the off-time interval, wherein said signal generator is configured to determine the duration of the off-time interval from the current though said inductive element, and wherein the signal generator further comprises:

a measuring element to measure a duration of the off-time interval, an estimating element, coupled to said measuring element, to produce a first signal representative of an estimated average current through said light-emitting device, a calculating element, coupled to said estimating element, to produce an error signal by subtracting said first signal from a signal representative of said target average current through said light-emitting device, and a controller, coupled to said measuring element and to said subtracting element, to control the duration of the off-time interval.

2. The apparatus of claim 1, wherein the unidirectionally conductive light-emitting device is a light-emitting diode.

3. The apparatus of claim 1, wherein the switching element is a field-effect transistor.

4. The apparatus of claim 1, wherein said signal generator and said switching element are formed on an integrated circuit.

5. The apparatus of claim 1, wherein the signal generator is configured such that at least one of the on-time interval and the off-time interval is adjustable.

6. The apparatus of claim 1, wherein said signal generator determines the duration of the off-time interval from a predetermined average current through the light-emitting device.

7. The apparatus of claim 1, wherein the signal generator is implemented as a digital circuit.

8. A power control circuit, comprising:

an inductive element coupled in parallel to a light-emitting device;

a switching element to couple the inductive element and light emitting device to a power supply to apply a charging current to the inductive element when the switch is in a first condition and to discharge the inductive element to the light-emitting device to generate light when the switch is in a second condition, wherein the switching element is placed in the second condition for a time interval determined by a magnitude of the charging current; and a comparator circuit wherein a signal related to the magnitude of the charging current is compared to a reference signal to control the switching of the switch from the second condition to the first condition.

9. The circuit of claim 8, wherein the light-emitting device comprises a light emitting diode.

10. The circuit of claim 8, wherein the switching element is a field effect transistor.

11. The circuit of claim 8, further comprising:

a selecting element coupled to said comparator circuit to select said reference signal from a plurality of reference signals.

12. The circuit of claim 11, further comprising:

a voltage divider coupled to said selecting element to produce said plurality of reference signals from a reference supply voltage.

13. The circuit of claim 8, further comprising:

a signal generator circuit is coupled to said switch to control the time duration the switch remains in at least one of the first condition and the second condition.

14. The circuit of claim 13, wherein the signal generator circuit is configured to define the time duration in the second condition from the time duration in the first condition.

15. A power control circuit, comprising:

an inductive element coupled in parallel to a light-emittina device:

a switching element to couple the inductive element and light emitting device to a power supply to apply a charging current to the inductive element when the switch is in a first condition and to discharge the inductive element to the light-emitting device to generate light when the switch is in a second condition:

a signal generator circuit coupled to said switch to control the time duration the switch remains in at least one of the first condition and the second condition, wherein the signal generator circuit comprises:

a measuring element to measure the time duration of the second condition;

an estimating element coupled to said measuring element, to produce a signal representative of an estimated average current through said light-emitting device;

a subtracting element coupled to said estimating element, to produce an error signal by subtracting said signal from a signal representative of said target average current through said light-emitting device; and a controller coupled to said measuring element and to said subtracting element, to drive the switch to produce a predetermined time duration of the second condition.

16. A method to control power to a light-emitting device, comprising:

coupling an inductive element in parallel to the light-emitting device;

switching the inductive element repeatedly between a first state during which said inductive element receives a charging current and a second state during which the inductive element discharges the charging current through said light-emitting device; and providing the light emitting device with a unidirectionally conductive valve element to allow current through the light-emitting device in a flow direction only during the second state:

wherein switching the inductive element also comprises:

measuring the duration of the second state, estimating an average current through said light-emitting device during the second state, subtracting said estimated average current through said light-emitting device from a predetermined target average current through said light-emitting device to produce an error signal, and adjusting the duration of the second state in accordance with the error signal.

17. The method of claim 16, wherein the duration of one or both of the first state and the second state is controllable.

18. The method of claim 16, further comprising:

dimming the light-emitting device by equally increasing the duration of the first state and the duration of the second state with a first dim-on time constant to a target power.

19. The method of claim 18, further comprising:

dimming said light-emitting device by decreasing the duration of said discharge state with a second dim-on time constant to a target power.

20. The method of claim 18, further comprising:

dimming said light-emitting device off by equally decreasing said duration of said first state and said duration of said second state with a second dim-off time constant to zero power.

* * * * *

UNITED STATES PATENT AND TRADEMARK OFFICE

CERTIFICATE OF CORRECTION

PATENT NO. : 7,557,519 B2
APPLICATION NO. : 11/532011
DATED : July 7, 2009
INVENTOR(S) : Christian Kranz It is certified that error appears in the above-identified patent and that said Letters Patent is hereby corrected as shown below:

On Sheet 3 of 11, Figure 3A, below Reference Numeral 372, line 1, delete " $V_{REFo}$ " and insert -- $V_{REF0}$ --, therefor.

On Sheet 9 of 11, Figure 7A, below $V_D$=13.5V, line 1, delete "$I_{R\text{-}PEAK}$" and insert -- $I_{R_PEAK}$ --, therefor.

On Sheet 9 of 11, Figure 7B, below $V_D$=12.8V, line 1, delete "$I_{R\text{-}PEAK}$" and insert -- $I_{R_PEAK}$ --, therefor.

On Sheet 9 of 11, Figure 7C, below $V_D$=11.6V, line 1, delete "$I_{R\text{-}PEAK}$" and insert -- $I_{R_PEAK}$ --, therefor.

On Sheet 10 of 11, Figure 8A, above DIM-ON, line 1, delete "DIM-ON1" and insert -- DIM-ON2 --, therefor.

On Sheet 10 of 11, Figure 8A, above DIM- OFF, line 1, delete "DIM-OFF1" and insert -- DIM-OFF2 --, therefor.

In column 2, line 3, delete "dim on" and insert -- dim-on --, therefor.

In column 7, line 26, delete "$I_R$" and insert -- $I_{R.}$ --, therefor.

In column 10, line 56, delete "$V_{SP,}$" and insert -- $V_{PS,}$ --, therefor.

In column 13, line 38, in Claim 1, delete "though" and insert -- through --, therefor.

In column 14, lines 37-38, in Claim 15, delete "light-emittina device:" and insert -- light-emitting device; --, therefor.

In column 14, line 44, in Claim 15, delete "condition:" and insert -- condition; --, therefor.

In column 15, line 6, in Claim 16, delete "state:" and insert -- state; --, therefor.

Signed and Sealed this

Twenty-third Day of March, 2010

David J. Kappos

David J. Kappos
*Director of the United States Patent and Trademark Office*